United States Patent [19]

Nishitani et al.

[11] 4,051,787

[45] Oct. 4, 1977

[54] PLASTIC PALLET

[75] Inventors: Kiyoshi Nishitani, Yokohama; Ryuzo Ebina, Tokyo; Ikuo Sukekawa; Shuji Shintani, both of Yokohama, all of Japan

[73] Assignee: Mitsubishi Chemical Industries Limited, Tokyo, Japan

[21] Appl. No.: 617,788

[22] Filed: Sept. 29, 1975

[30] Foreign Application Priority Data

May 6, 1975 Japan ..... 50-54044
May 20, 1975 Japan ..... 50-59935

[51] Int. Cl.[2] ..... B65D 19/44

[52] U.S. Cl. ..... 108/55.3; 108/51.1; 108/901

[58] Field of Search ..... 108/51-58; 85/39; 52/182; 182/228; 198/198, 199; 206/386

[56] References Cited

U.S. PATENT DOCUMENTS

| | | | |
|---|---|---|---|
| 2,762,593 | 9/1956 | Weiss | 108/57 |
| 3,093,216 | 6/1963 | Dunham | 108/51 UX |
| 3,298,327 | 1/1967 | Grimes | 108/57 |
| 3,433,184 | 3/1969 | Addy | 108/58 X |
| 3,490,583 | 1/1970 | Cook | 206/386 |
| 3,630,157 | 12/1971 | Ortenblad | 108/53 |
| 3,702,100 | 11/1972 | Wharton | 108/53 |
| 3,720,176 | 3/1973 | Munroe | 108/51 X |
| 3,916,803 | 11/1975 | Garcia | 108/58 X |
| 3,938,448 | 2/1976 | Nishitani et al. | 108/58 |
| 3,964,400 | 6/1976 | Brand | 108/51.1 |

*Primary Examiner*—Roy D. Frazier
*Assistant Examiner*—William E. Lyddane
*Attorney, Agent, or Firm*—Oblon, Fisher, Spivak, McClelland & Maier

[57] ABSTRACT

A pallet for a fork lift structurally comprises two component parts of thermoplastic resin wherein each of said component parts comprises a deck board and girders integrally formed thereon with at least one girder being disposed along each of the side edges of said deck board and along a line intermediate and parallel to the side edges, at least one of said component parts being provided with numerous ribs integrally formed on said deck board, which are lower in projection than said girders and which in areas not covered by said girders are disposed in decreased distance from one another in the neighborhood of the side edges of the deck board, said component parts being mutually melt adhered together at the respective bottom surfaces of said girders provided thereon, and wherein the deck board is provided with an anti-slip member having an upper and a lower portion and fitted into a hole penetrating a rib interally formed on the deckboard so that the lower portion of the anti-slip member protrudes from the rib.

12 Claims, 25 Drawing Figures

PLASTIC PALLET

BACKGROUND OF THE INVENTION

1. Field of the Invention

The present invention relates to a plastic pallet and more particularly to a pallet made of synthetic resin for use with a fork lift. Further, in a specific aspect, the present invention relates to a plastic pallet having a fork-inserting mouth on each of its four sides with the mouths of adjacent sides being at different levels.

2. Description of the Prior Art

Heretofore, the material most commonly used for constructing a pallet for a fork lift has been lumber. However, lumber is not entirely satisfactory because of certain natural deficiencies, such as the limitation of natural resources, unstable supply, poor chemical resistance of the product, and the necessarily complicated manufacturing methods employed to make them. Metallic pallets also are available, but they are expensive. Therefore, recently, attempts have been made to produce a plastic pallet.

As is well known, however, a pallet for a fork lift is usually constructed from two sheets of deck board joined by parallel girder materials provided at their respective opposite edges and intermediate portions whereby a space is provided between the girder portions for receiving the fork. Therefore, a shortcoming of these conventional plastic pallets is that they compare unfavorably with the wooden or metallic pallet in strength and resistance to bending because of the natural characteristics of plastic.

Also, since the pallet for a fork lift is, as described hereinabove, a hollow body having a fork-inserting mouth, a one-step molding process, such as, for example, an injection molding process using a thermoplastic material, would require a metallic mold equipped with a sliding core. One-step injection molding of a pallet is very difficult with conventional molding machines because they are so large.

Furthermore, it is difficult to obtain a plastic pallet which is characteristically comparable to the wooden or metallic pallets in bending strength, even using compression molding, extrusion molding and the like, because the pallet for a fork lift has the particular construction described above.

In addition, an enormous molding machine would be required to mold an item such as a pallet having large dimensions and weight. Therefore, such a pallet is remarkably expensive, both in its high initial cost and for its general maintenance.

SUMMARY OF THE INVENTION

Accordingly, it is an object of the present invention to provide a plastic pallet, for use with a fork lift, which has excellent bending strength characteristics and which is also relatively low in cost and easy to manufacture.

Another object of the present invention is to provide a plastic pallet, for use with a fork lift, which has excellent bending strength characteristics and advantages in handling.

Still another object of this invention is to provide a novel method for manufacturing a plastic pallet for use with a fork lift.

Yet another object of this invention is to provide a new and improved method of manufacturing a molded plastic pallet for use with a fork lift which has high bending strength characteristics which are remarkably superior to those of the conventional plastic pallets and comparable to those of wooden pallets.

Briefly, these and other objects of this invention, as will hereinafter become clear from the ensuing discussion, have been attained by providing a pallet for a fork lift constructed of a thermoplastic synthetic resin which structurally comprises two component parts of the thermoplastic synthetic resin which are mutually melt adhered together at the respective bottom surfaces of girders provided thereon, each of said component parts having a construction comprising a deckboard and a plurality of girders integrally formed thereon with at least one girder being disposed on each side portion of said deckboard and one therebetween, at least one of said component parts being numerous ribs integrally formed on said deckboard which are lower in projection than said girders, and which in the areas not covered by the girders are disposed in decreased distance from one another or are broader in width in the neighborhood of the side edges of the deckboard. In a specific aspect, there is provided a plastic pallet for a fork lift having a fork-inserting mouth on each of all four sides such that the mouths on adjacent sides are at different levels.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several figures and wherein.

DESCRIPTION OF THE PREFERRED EMBODIMENTS

Any suitable thermoplastic resin may be used as the material for manufacturing the pallet of the present invention.

Such suitable resins include, for example, polyolefin resins such as polyethylene, polypropylene, and ethylene-propylene copolymers; polystyrene resins such as acrylonitrile-styrene copolymers, acrylonitrile-styrene-butadiene copolymers, and polyvinylchloride resins, and the like. These plastic materials are preferably used as compositions blended with conventional foaming agents such as volatile foaming agents and heat decomposable foaming agents used for manufacturing the component parts of plastic pallets. Of course, they also may be molded in their usual forms. Pallets made of component parts obtained from such compositions are most preferred in terms of weight of strength since they are molded in the form of low-foamed bodies such that the surface layers are non-foamed.

Any known foaming agent may be compounded with the resin. If desired, conventional additives such as filters, pigments, plasticizers and the like may also be included.

For manufacturing a pallet according to the present invention, two component parts (*a* and *b* of FIGS. 3 and 16) forming the pallet are first separately molded, using any of the thermoplastic materials above. The molding operation can be easily and inexpensively carried out using a metallic mold lower in strength than conventional molds such as aluminum molds. That is, the molding operation can be performed under lower mold clamping pressure than is usual. Therefore, inexpensive apparatus can be used. Of course, highly efficient molding methods such as injection molding may also be employed.

Figure 3:
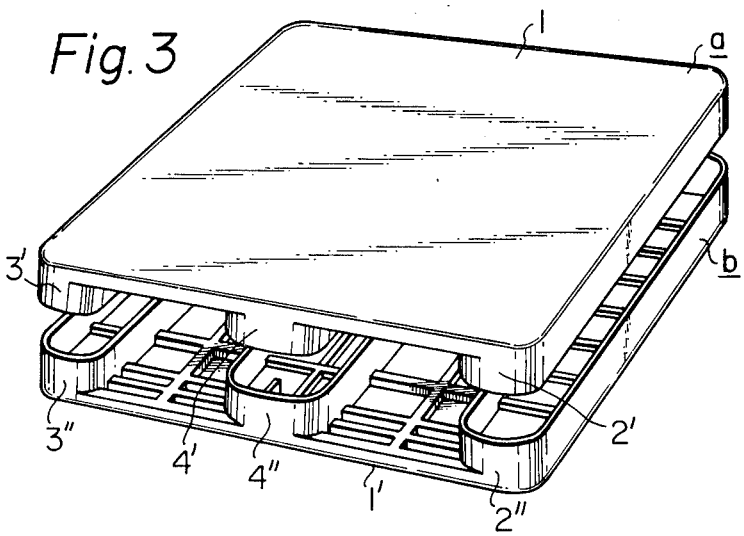
FIG. 3 is a perspective view showing an aspect of manufacturing the pallet shown in FIG. 1.

The component parts a and b, shown in FIG. 3, respectively comprise upper and lower deckboards 1 and 1', each having projecting girders 2' and 2'', respectively, integrally formed along the side edges thereof. Similar projecting girders 3' and 3'', respectively, are integrally formed along the opposite parallel edge of the respective boards, and another set of girders 4' and 4'' are integrally formed thereon along a line intermediate and parallel to the two edges having the girders 2', 2'' and 3', 3''. At least one of the component parts *a* and *b* has numerous ribs 5 integrally formed on the deckboard. These ribs are lower in projection than said girders. Said ribs are provided in decreased distance from one another in the neighborhood of the side edges of the deckboard.

The component parts *a* and *b*, which have been separately molded by conventional molding techniques, are then mutually melt adhered at the bottom of the exposed surfaces of the respective opposing girders 2', 3' and 4' and 2'', 3'' and 4''. The most common means for melt adhering the parts comprises contacting the bottom surfaces of the opposing girders of the parts *a* and *b* with the surface of a heating plate to melt the bottom surfaces, then removing the heating plate, and, after press-adhering the bottom surfaces of the girders of the part *a* in the molten state with that of the part *b*, cooling them. A metallic plate coated with Teflon is preferably used as the heating plate. It should be maintained at a temperature higher than the melting temperature of the component parts used for molding.

Figure 5:
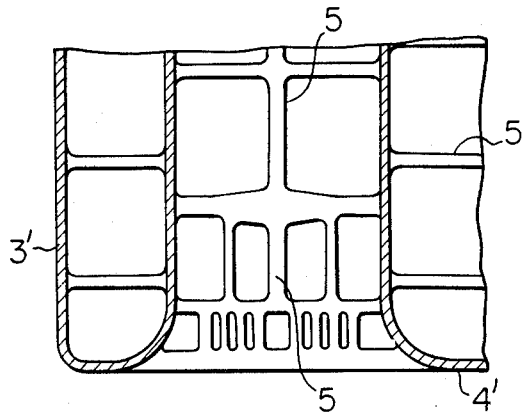
FIGS. 5, 6 and 7 are partial cross-sectional views of another embodiment of the pallet of the present invention.
Figure 6:
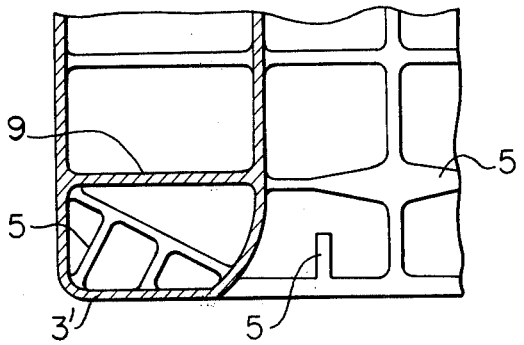
Figure 7:
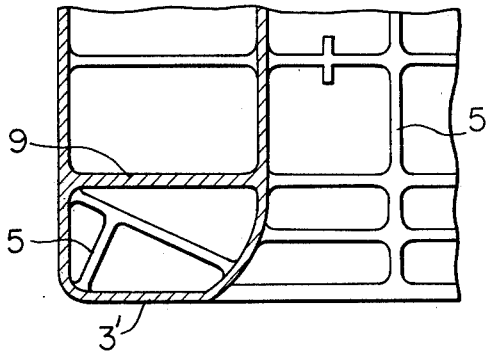

In the Figures, ribs 5 provided between girders are integrally formed on the deckboard. As clearly shown in FIG. 4, the distance between the ribs is decreased in the neighborhood of the side edges of the deckboard. For example, in FIG. 4, the ribs perpendicular to the fork-inserting direction are disposed parallel to one another in decreased distance in the neighborhood of the side edges. In FIG. 5, ribs perpendicular to the fork-inserting direction and ribs parallel to the same direction are combined; and in FIGS. 6, 7 and 14, they are combined in various other forms.

Figure 14:
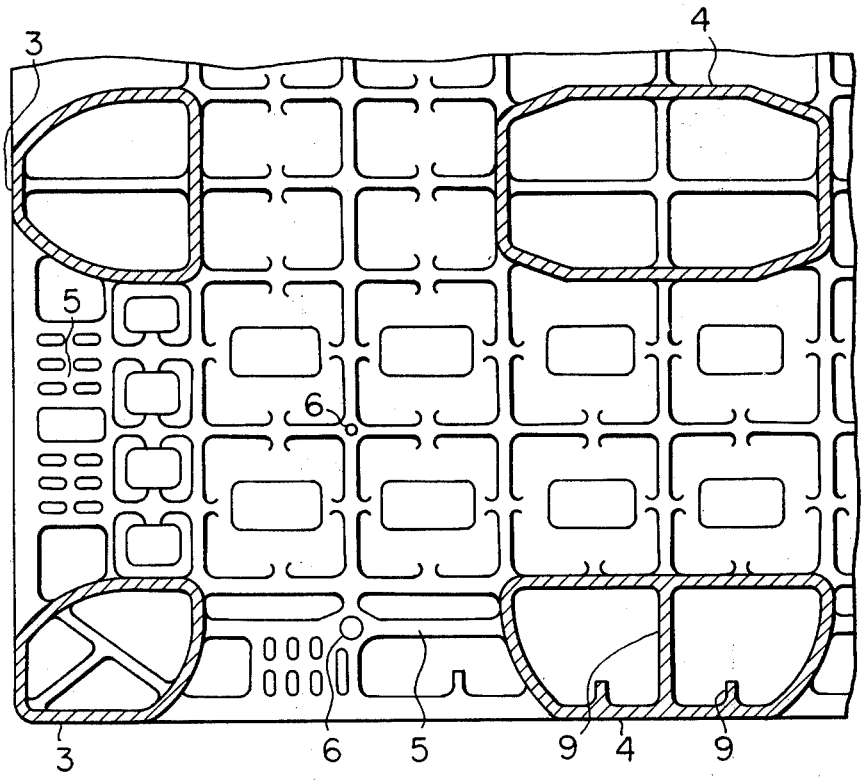
FIG. 14 is a partially enlarged cross-sectional view along the line D—D of FIG. 9.
Figure 15:
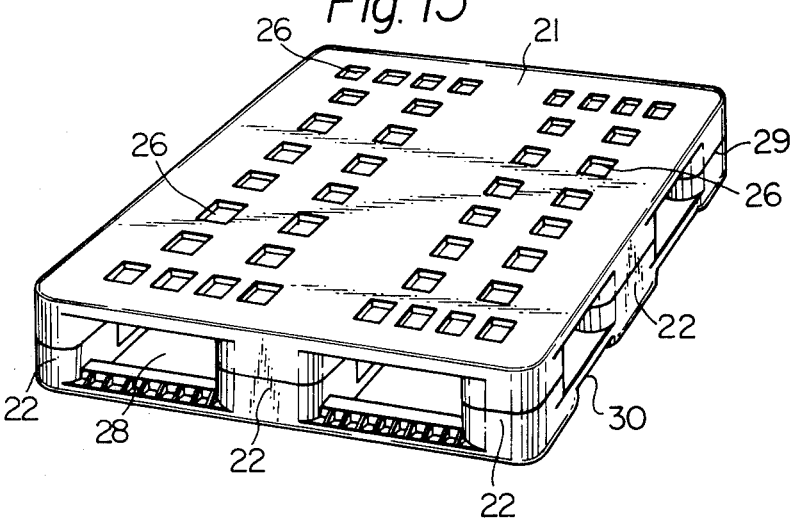
FIG. 15 is a perspective view of a specific embodiment of the pallet of the present invention.

Because of this structure, the pallet will not deflect when used for transportation of loads and, when the fork is inserted into the pallet, the deckboard will not be destroyed by the force of the collision with the fork. As shown in FIGS. 5 and 14, by providing numerous ribs parallel to the fork-inserting direction in the neighborhood of the side edges of deckboard 1, collision of the fork with ribs perpendicular to the fork-inserting direction will be avoided, thereby preventing destruction of the rib structure. Moreover, preferably these ribs also serve the purpose of supporting the pallets, when piled up on an automatic pallet delivery machine (palletizer). Of course, these ribs may be provided on both component parts. However, preferably they are provided at least on the back surface of deckboard 1—the part carrying the load (i.e., on the inside surface of the pallet body). When the ribs are provided on the back surface of the deckboard, the height of the ribs must, of course, be lower than that of the girders in order to form a space for inserting the fork of a fork lift device when the pallet is assembled. Provision of many ribs on the surfaces of the deckboards serves to decrease the flexure of the pallet and to increase its strength when the loaded pallet is lifted by the fork lift.

Figure 23:
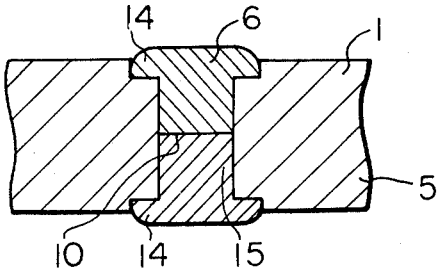
Figure 24:
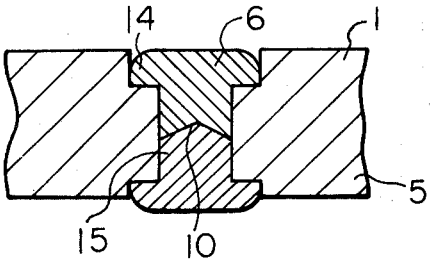
Figure 25:
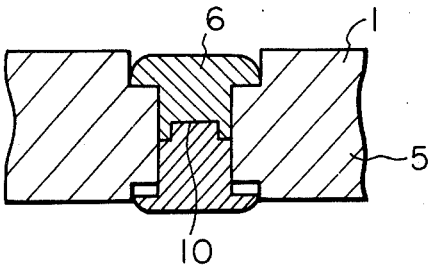

The deckboard of at least one of the component parts is preferably provided with at least one kind of anti-slip means 6, 7 and 8 made of rubber on its surface. The anti-slip means is fitted on the surface of the deckboard by fitting or coating when laid bare. It is particularly preferred that the upper fringes of these anti-slip means are disposed in positions curving from the surface of the deckboard. As shown in FIGS. 1, 2, 4, 14, 23, 24 and 25, each of the anti-slip means 6 is fitted into a hole penetrating the component part above the surfaces of the deckboard and are provided so as to protrude into the upper central portion thereof above the surface of deckboard 1 and also into the lower central portion thereof above the ribs 5 integrally formed on the deckboard 1. Thus, sliding between pallet and loads as well as between pallet and fork is prevented. In one embodiment, FIG. 23 shows an anti-slip means 6 protruding from both the surface of deckboard 1 and the rib 5; FIG. 24 shows an anti-slip means 6 protruding from only the rib 5 and not protruding to the surface of deckboard 1 so that the anti-slip means is on the same level as the surface or lower. This is useful in the case where the load slides only with difficulty or in the case where a material, for example, paper which is easily damaged by an uneven surface is loaded. FIG. 25 shows an anti-slip means 6 protruding from only the ribs 5 and not protruding above the surface of the deckboard in an unloaded state but which is pushed out to the surface of deckboard 1 by the action of the fork when the fork is inserted into the pallet. This has the advantage that the pallet can be loaded without interference of the anti-slip means 6 while in the transportation of the pallet, the anti-slip means 6 protrudes to give an anit-slipping effect.

In any event, the anti-slip means 6 can be a cylindrical or square form of rubber elastomer comprising ends 14 of a large diameter protruding from the surface of deckboard 1 and the rib 5, and a built-in portion 15 of smaller diameter. The anti-slip means 6 can be fitted into the deck by inserting each of the anti-slip means 6 divided in two into the surface of deckboard 1 and the rib 5 and then connecting the two divided anti-slip means at the point of contact with an adhesive. Alternatively, heat melt adherence or mechanical bonding can be used. The connecting surface 10 may have various shapes, as shown in FIGS. 23 to 25.

Figure 4:
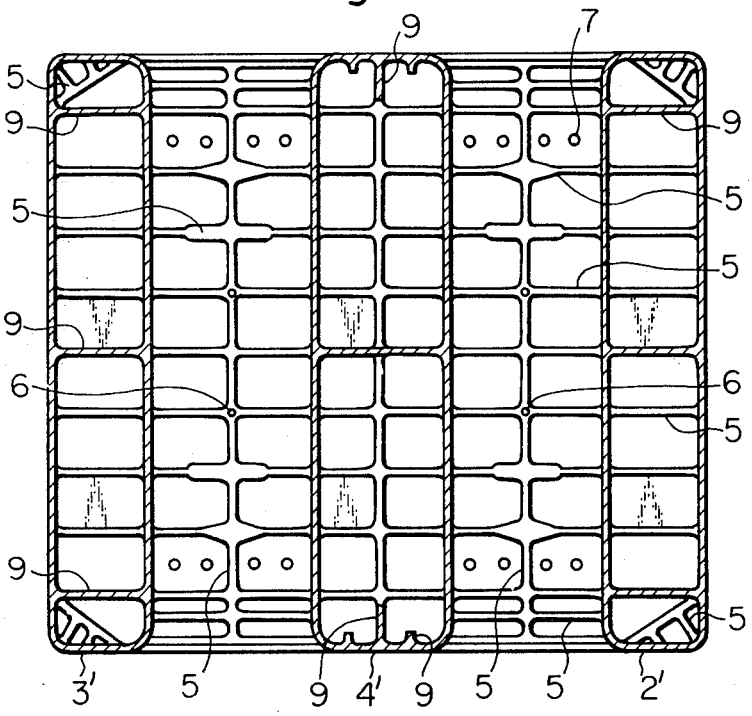
FIG. 4 is a cross-sectional view along the line A—A of FIG. 2.
Figure 20:
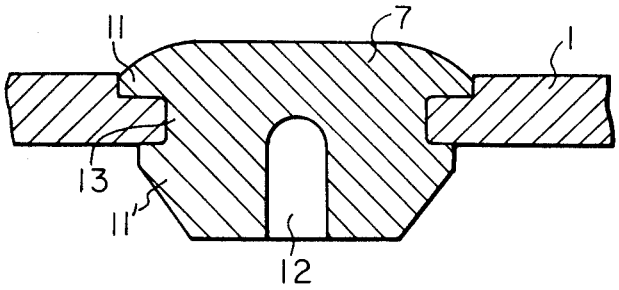
FIGS. 20 to 25 are vertical sections of anti-slip means.

Another type of anti-slip means 7, as shown in FIGS. 4 and 20, can be provided on a portion of the deckboard not provided with a rib 5 in the component part. The anti-slip means 7 is composed of a part 13 of smaller diameter built into the deckboard and two parts 11 and 11' of larger diameter integrally formed on both sides of the smaller diameter part. The larger diameter part 11 of the anti-slip means on the surface of the deckboard 1 is larger in diameter than the other part 11' on the back side of the deckboard 1. The anti-slip means 7 has a hollow portion 12 in the central part of the smaller diameter part 11', which extends to the part 13 built in the deckboard. This is for the purpose of deforming the part 11' to the same size as the diameter of the part 13 when pressing the anti-slip means 7 into the deckboard 1 from the surface side.

The sizes of the anti-slip means 6 and 7 can be selected according to the intended use of the pallet. Any materials effective as anti-slip surfaces can be used. Suitable materials include natural rubber and synthetic rubber such as butadiene-styrol copolymer, butadiene-acrylonitrile copolymer, thiokol, ethylene-propylene copolymer, chlorosulfonated polyethylene, urethane and the like.

Figure 1:
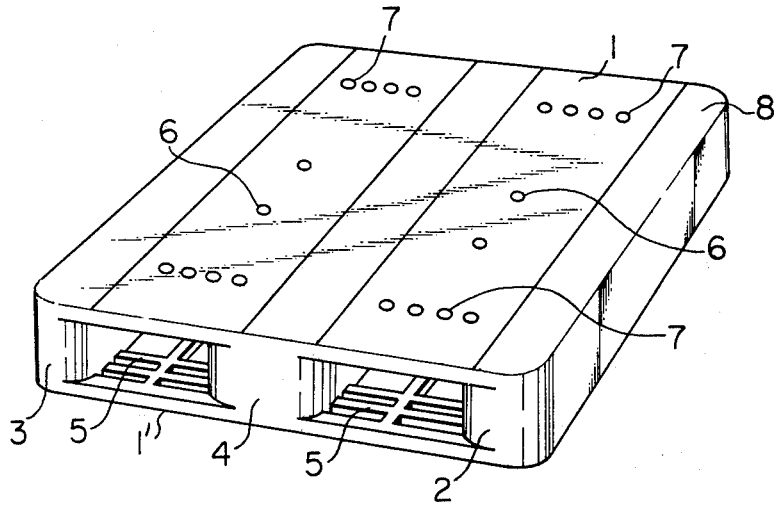
FIG. 1 is a perspective view of one embodiment of a pallet constructed according to the present invention.
Figure 2:
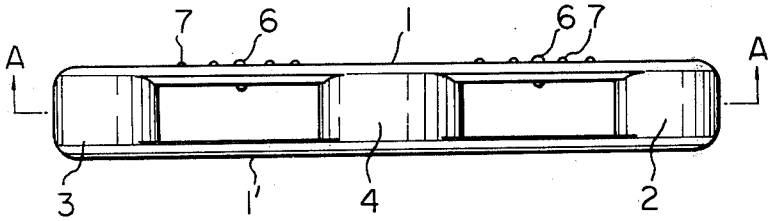
FIG. 2 is a front elevation of the pallet shown in FIG. 1.
Figure 21:
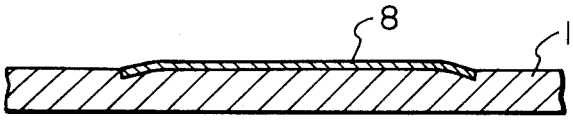
Figure 22:
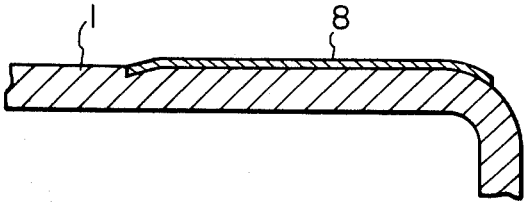

Additionally, an anti-slip means 8, as shown in FIGS. 1, 21 and 22, can be provided in the form of a thin layer on at least one part of the surface of the deckboard 1. The anti-slip means 8 is provided by coating a synthetic rubber dissolved in a solvent on the surface of the deckboard or joining a thin sheet of rubber onto the deckboard with an adhesive or by heat melt adherence. In particular, the method of coating a thermoplastic rubber such as polystyrene-polybutadiene-polystyrene copolymer, polystyrene-polyisoprene-polystyrene copolymer and the like dissolved in a solvent is preferred. The surface of deckboard 1 of the pallet provided with the anti-slip means 8 is preferably subjected to a surface treatment, such as surface roughening by sand blasting, shot blasting, flame treatment, corona discharge treatment, oxidation with an oxidizing agent, coating of adhesive layer, and the like in order to increase the adhesiveness of the surface to rubber. The anti-slip means 8 is preferably provided on girders 2, 3 and 4, as shown in FIG. 1, to decrease the likelihood of peeling caused by deformation.

The edge of the anti-slip means on the surface of the deckboard, (i.e., the edges of the large diameter portions 14 and 11 of anti-slip means 6 and 7, respectively; and the edge of anti-slip means 8) should curve toward the surface of the deckboard, as shown in FIGS. 20 to 25. Thereby, the anti-slip means 6, 7 and 8 will not fall out or peel out in loading.

The girders 2, 3, and 4 of the pallet made by mutually melt adhering the corresponding girders of the component parts together preferably are hollow and are preferably provided with ribs 5 in their interiors.

In particular, it is preferred, in view of the strength of the pallet, that the intermediate girder 4 of the deckboard be larger in width than the girders 2 and 3 along the side edges.

Girder 4 is preferably provided with a reinforcing strip 9 extending in the same direction as the fork-inserting direction in the neighborhood of the side edge of the deckboard in the interior hollow space thereof, as shown in FIGS. 4 and 14. This is preferred because the girder 4 can be easily destroyed by collision with a fork at the time of its insertion into the pallet. This reinforcing strip 9 must be extended over the upper and lower deckboards 1 and 1' in order to prevent the girder 4 from destruction by impact. Of course, the reinforcing strip 9 can also be provided in the interior of the girders 2 and 3 to reinforce the corner of the pallet which strongly couples with the ribs 5 provided in the interior of girders 2 and 3, particularly the ribs 5 lower in projection than the girder extending from the corner of the pallet. The ribs 5 in the corner may be used as such a reinforcing strip 9 by making their heights equal to that of the girder.

Figure 8:
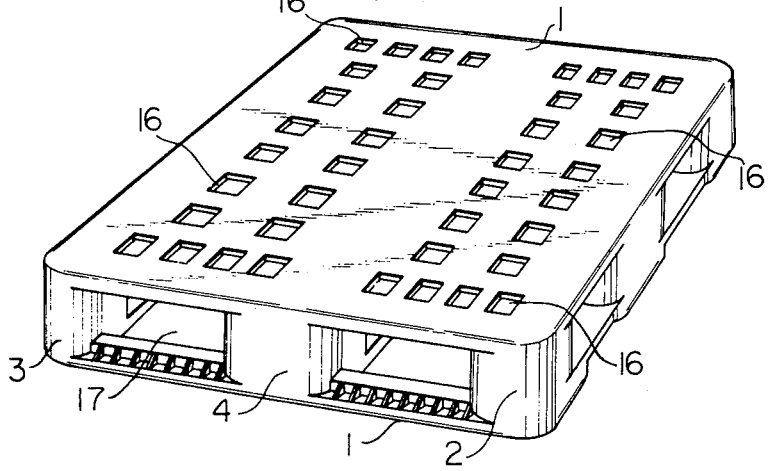
FIG. 8 is a perspective view of another embodiment of the pallet of the present invention.
Figure 9:
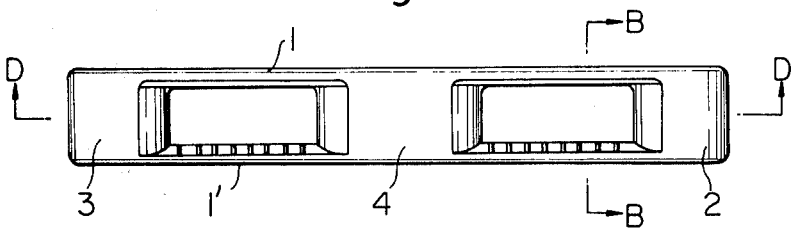
FIG. 9 is a front elevation of the pallet shown in FIG. 8.
Figure 10:
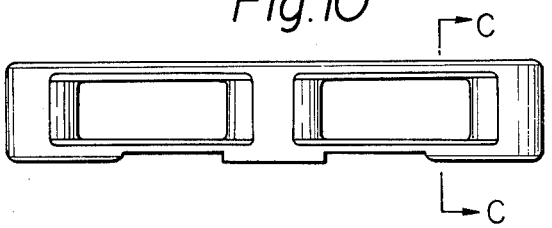
FIG. 10 is a side elevation of the pallet shown in FIG. 8.

The number and shape of the girders in the pallet can be properly selected according to the use and method of utilization. For example, in a common pallet having two fork-inserting mouths, as shown in FIG. 1, girders are provided lengthwise parallel to the fork-inserting direction along both side edges of the deckboard and along the middle. It is rounded in the corners of the pallet. In a pallet having four fork-inserting mouths, a girder is preferably provided in at least five places, i.e., along the central part and the four corners of the deckboard. In general, as shown in FIG. 8, three girders are provided along both side edges of the deckboard and along the middle.

These girders are rounded in the corners of the pallet to decrease the impact of the fork or to allow the fork to slip therefrom in case the fork collides with the girder, thereby preventing destruction.

The component parts *a* and *b* are preferably composed so as to satisfy the above-described requirements, and particularly must be identical in the positions of the girders to be melt adhered. Thus, a strong hollow girder for the pallet will be obtained.

When both component parts *a* and *b* are identical in structure, both surfaces of the pallet obtained can be utilized. However, the pallet of the present invention is not limited to such pallets having identical component parts *a* and *b*. The lower component *b* may be modified to any specific structure suitable for a pallet using only one side surface. For example, as shown in FIGS. 8 to 13, the lower component part can have such a structure that the adjacent girders are connected lengthwise and breadthwise on the deckboard of the lower component part by providing a plurality of relatively large openings 17 in the deckboard. Such a pallet structure can also have openings 16 in the deckboard which is the loading surface, thereby rendering it suitable for use in a wet environment, since it drains well if it is exposed to rain or is washed with water. When ribs 5 are provided on the deckboard 1' of the lower component part, they preferably have such a structure that the zone surrounded on all sides by ribs is not fully encompassed such that water can be trapped. In other words, at least one side should be opened sidewards or downwards as in the preferred structures shown in FIGS. 12 and 13.

Figure 11:
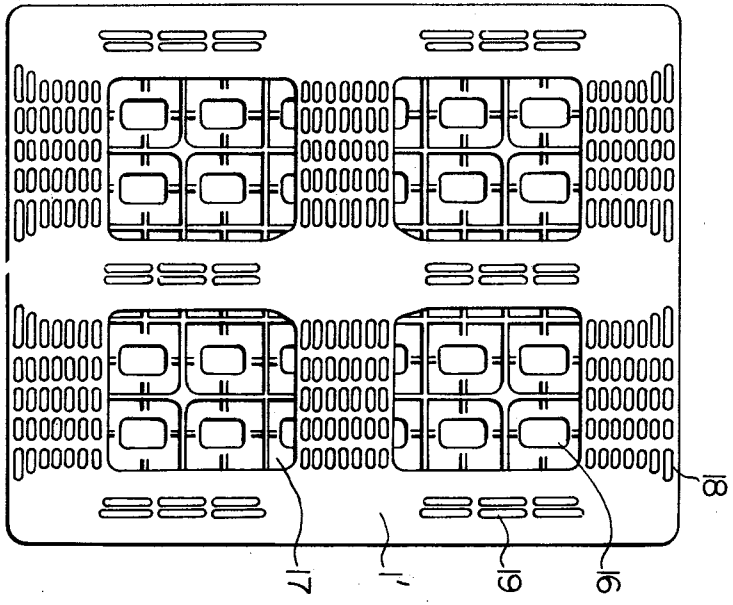
FIG. 11 is a bottom view of the pallet shown in FIG. 8 or FIG. 15.
Figure 12:
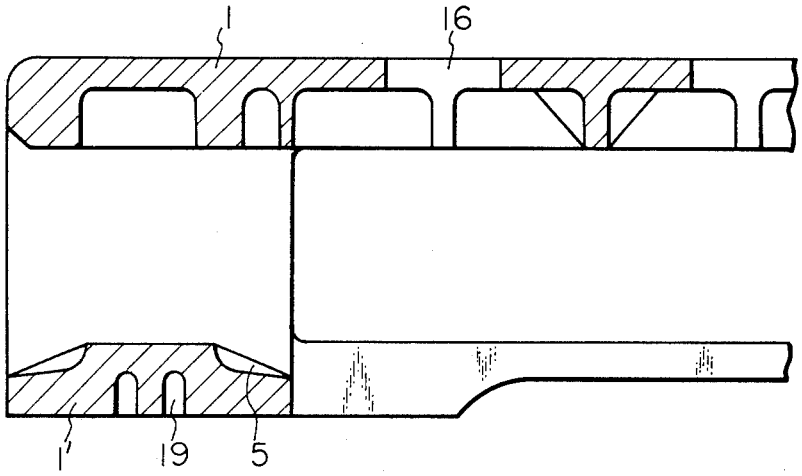
FIG. 12 is a partially enlarged cross-sectional view along the line B—B of FIG. 9.
Figure 13:
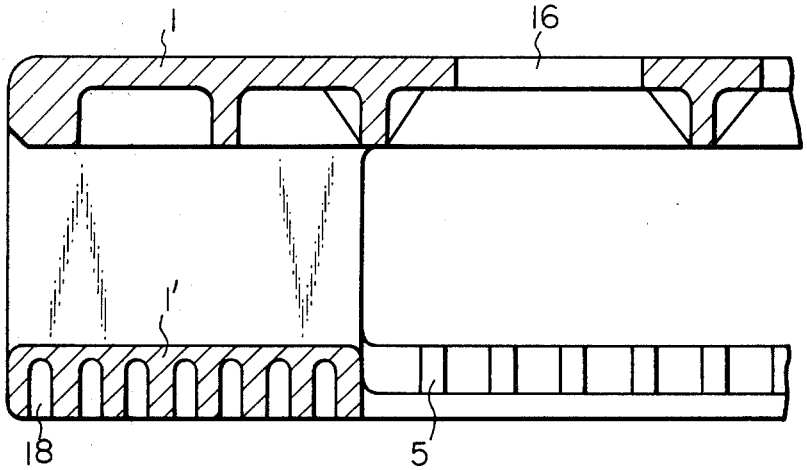
FIG. 13 is a partially enlarged cross-sectional view along the line C—C of FIG. 10.

When ribs 5 are provided on the surface of the deckboard of the lower component part, the ribs are in danger of being destroyed at the time of any transportation or loading. Therefore, a structure provided with hollows 18 and 19 or numerous holes in the ribs as shown in FIGS. 11, 12 and 13 is preferred.

The present invention will be further illustrated by specific embodiments with drawings which are not intended to be limiting unless otherwise specified.

In FIGS. 15–19, the inner surface of the upper deckboard 21 is provided with reinforcing ribs 27 integrally formed thereon, which are disposed crossing lengthwise and breadthwise in the same directions as the fork-inserting directions. For example, when the ribs 27 are provided in the fork-inserting direction from the central part of the fork-inserting mouth, the rib 27 serves the purpose of guiding the fork of the fork lift. The upper deckboard 21 may be provided with openings 26 if desired. The openings 26, in view of strength, are preferably provided in a place surrounded by the above-described reinforcing ribs.

The girder 22 integrally formed on the upper deckboard 21 and on the lower deckboard 25 is divided at its central part. Each of the divided girders is integrally formed by the deckboard of the upper component part *a* and that of the lower component part *b*. Both are melt adhered along the junction 29 to be integrated into a pallet.

The space formed by the deckboards and girders provides fork-inserting mouths 23 and 24.

Figure 16:
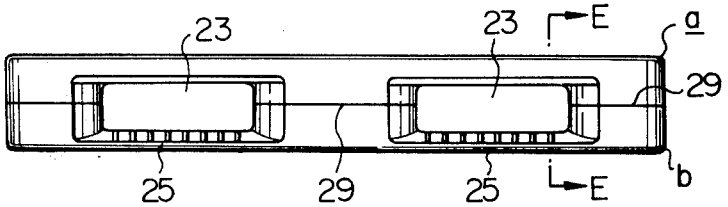
FIG. 16 is a front elevation of the pallet shown in FIG. 15.
Figure 17:
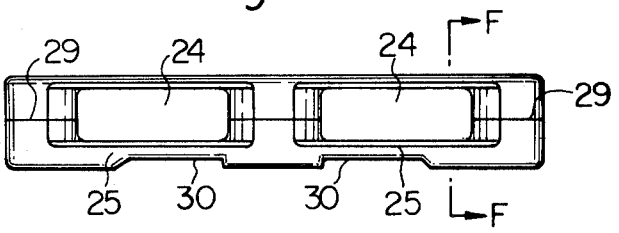
FIG. 17 is a side elevation of the pallet shown in FIG. 15.

As is evident from FIGS. 16 and 17, the pallet of the present invention is characterized in that the front fork-inserting mouth 23 and the side fork-inserting mouth 24 are provided at different levels. The level of the back fork-inserting mouth may be the same as or different from that of the front mouth. The same is true for the opposite side fork-inserting mouths. The bending strength of the pallet is increased by such a structure. This pallet structure can be effectively employed particularly in a narrow or automatic pallet warehouse and the like since, for example, while transporting the pallet with a fork inserted into the side fork-inserting mouth 24, the pallet can be handed over to another fork lift by inserting its fork into the front fork-inserting mouth 23. Alternatively, if a cut-in portion 30 is provided on the lower deckboard, the same handing-over operation is possible.

Although the lower deckboard 25 may be the same as the upper deckboard 21 in structure, the deckboard is preferably provided with relatively large openings 28 forming, as shown in FIG. 11, a bridge connecting girders 22 lengthwise and breadthwise.

By providing such opening 28, use a hand lift (a hand-worked fork lift) is possible. As shown in FIG. 16, when the front fork-inserting mouth is at a lower level, a fork can be easily inserted. In this case, if the lower deckboard is inclined upward from the front fork-inserting mouth along the fork-inserting direction, a fork can be inserted more easily.

Figure 18:
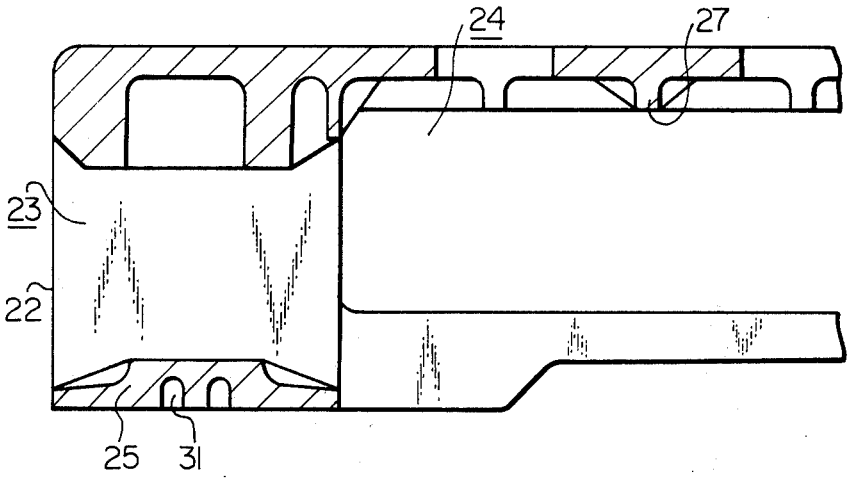
FIG. 18 is a partially enlarged cross-sectional view along the line E—E of FIG. 16.
Figure 19:
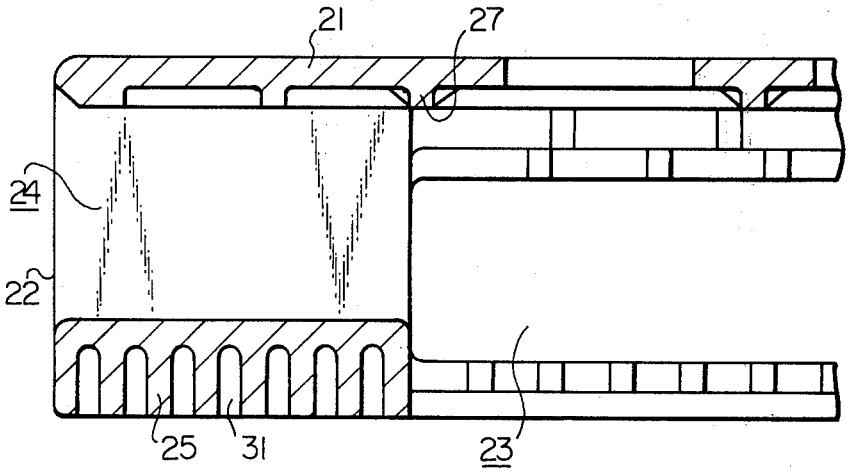
FIG. 19 is a partially enlarged cross-sectional view along the line F—F of FIG. 17.

As shown in FIGS. 18 and 19, the lower deckboard preferably has an even and smooth inner surface. If ribs are provided thereon, the side or bottom surface (i.e. the surface of the lower deckboard) of the portion surrounded by the ribs should preferably be in an opened form. Also, when the surface of the lower deckboard is as shown in FIGS. 11, 18 and 19, in such a structure it is preferred to have hollows 31 on the even surface because the ribs will be in danger of being destroyed at the time of transportation.

Thus, the pallet embodied in the present invention not only has excellent strength but also has the advantage that a transferring operation between forks is possible and that hand lift can be employed since the pallet is provided with front fork-inserting mouth 23 and a side fork-inserting mouth 24 mutually adjacent on different levels.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A pallet for a fork lift structurally comprising:

two mating component parts of thermoplastic resin wherein each of said components parts comprises a deckboard having inner and outer surfaces and girders integrally formed on said inner surfaces with at least one girder being disposed along each of the side edges of said deckboard and along a line intermediate and parallel to the side edges so as to define fork lift insertion openings therebetween, at least one of said component parts being provided with numerous ribs, integrally formed on the inner surface of said deckboard, which are lower in projection than said girders and which in areas not covered by said girders are disposed decreased distances from one another in the neighborhood of the side edges of the deckboard, said deck board being provided with an anti-slip means having an upper and lower portion and fitted into a hole penetrating a rib integrally formed on said deckboard so that the lower portion of said anti-slip means protrudes from said rib, and said component parts being mutually melt adhered together at the respective bottom surfaces of said girders.

2. The pallet as set forth in clain 1 wherein said anit-slip means protrudes from the outer surface of said deckboard.

3. The pallet as set forth in claim 1 wherein said anti-slip means does not protrude to the outer surface of said deckboard.

4. The pallet as set forth in claim 1 wherein said anti-slip means is provided in such a manner that the upper portion thereof protrudes from the outer surface of the deckboard when the lower portion thereof is touching an inserted fork.

5. The pallet as set forth in claim 1 wherein each of said girders, disposed along said line intermediate and parallel to both side edges, is hollow and is provided with reinforcing strips extending the same direction as the fork-inserting direction, and disposed intermediate the longitudinal side walls defining said girder and upon the transverse end walls of said girders defining a fork-inserting mouth, and having the same height as that of the girder, so that said component parts are mutually melt adhered together also at the respective bottom surface of said strips.

6. The pallet as set forth in claim 1 wherein each of said girders disposed along each of side edges of said deckboard is hollow and a rib extending from the point of the corner of said parallel is provided within said girders.

7. The pallet of claim 1 wherein said fork-inserting mouth is provided on each of all four sides of said pallet.

8. The pallet of claim 7 wherein said fork-inserting mouths on adjacent sides are disposed at different levels.

9. The pallet of claim 7 wherein the lower component part has a structure such that the adjacent girders are connected lengthwise and breadthwise on the deckboard of the lower component part by providing a plurality of relatively large openings in the deckboard.

10. The pallet of claim 1 wherein the inner surface of the lower deckboard is even and smooth.

11. The pallet of claim 1 wherein the inner surface of the lower deckboard is provided with ribs and the portion surrounded by said ribs is opened to provide good drainings along the side of the bottom surface of the lower deckboard so that water does not settle therein.

12. The pallet of claim 1 wherein, along the front and back sides, the inner surfaces of the lower deckboard is even and smooth while, along the other sides, the inner surface of the lower deckboard is provided with ribs and the portion surrounded by said ribs is opened to provide good drainage along the side or the bottom surface of the deckboard so that water does not settle therein.

* * * * *